US012601485B2

(12) United States Patent
Naik et al.

(10) Patent No.: US 12,601,485 B2
(45) Date of Patent: Apr. 14, 2026

(54) TURBINE ENGINE WITH FUEL NOZZLE

(71) Applicant: General Electric Company, Schenectady, NY (US)

(72) Inventors: Pradeep Naik, Bengaluru (IN); Perumallu Vukanti, Bengaluru (IN); Michael T. Bucaro, Arvada, CO (US); Steven C. Vise, West Chester, OH (US); Ajoy Patra, Bengaluru (IN); R Narasimha Chiranthan, Bengaluru (IN); Manampathy G. Giridharan, Evendale, OH (US); Michael A. Benjamin, Cincinnati, OH (US); Clayton S. Cooper, Evendale, OH (US); Dharmaraj Pachaiappan, Bengaluru (IN)

(73) Assignee: General Electric Company, Evendale, OH (US)

( * ) Notice: Subject to any disclaimer, the term of this patent is extended or adjusted under 35 U.S.C. 154(b) by 116 days.

(21) Appl. No.: 18/613,824

(22) Filed: Mar. 22, 2024

(65) Prior Publication Data

US 2025/0251131 A1 Aug. 7, 2025

Related U.S. Application Data

(63) Continuation of application No. 17/682,510, filed on Feb. 28, 2022, now Pat. No. 12,072,099.

(30) Foreign Application Priority Data

Dec. 21, 2021 (IN) ..... 202111059696

(51) Int. Cl.
*F23R 3/14* (2006.01)
*F23R 3/28* (2006.01)

(52) U.S. Cl.
CPC ..... *F23R 3/14* (2013.01); *F23R 3/286* (2013.01)

(58) Field of Classification Search
CPC ..... F23R 3/14; F23R 3/286
See application file for complete search history.

(56) References Cited

U.S. PATENT DOCUMENTS 3,946,552 A 3/1976 Weinstein et al.
4,198,815 A 4/1980 Bobo et al.
(Continued)

FOREIGN PATENT DOCUMENTS

CN 1598407 A 3/2005
CN 102809176 A 12/2012
(Continued)

OTHER PUBLICATIONS

Chinese Office Action for Application No. 202211055027.1 dated Mar. 20, 2025, with English translation, 16 pages.

*Primary Examiner* — William H Rodriguez
(74) *Attorney, Agent, or Firm* — Carter, DeLuca & Farrell LLP

(57) ABSTRACT

An engine can utilize a combustor to combust fuel to drive the engine. A fuel nozzle assembly can supply fuel to the combustor for combustion or ignition of the fuel. The fuel nozzle assembly can include a swirler and a fuel nozzle to supply a mixture of fuel and air for combustion. Increasing efficiency and meeting emission needs can be met with the use of alternative fuels, which combust at higher temperatures or higher speeds than traditional fuels, requiring improved fuel introduction without the occurrence of flame holding or flashback.

20 Claims, 10 Drawing Sheets

(56) References Cited

U.S. PATENT DOCUMENTS

| | | | | |
|---|---|---|---|---|
| 5,319,935 | A | 6/1994 | Toon et al. | |
| 5,417,070 | A | 5/1995 | Richardson | |
| 5,490,378 | A | 2/1996 | Berger et al. | |
| 5,505,045 | A | 4/1996 | Lee et al. | |
| 5,826,423 | A | 10/1998 | Lockyer et al. | |
| 5,916,142 | A | 6/1999 | Snyder et al. | |
| 5,941,075 | A | 8/1999 | Ansart et al. | |
| 5,966,937 | A | 10/1999 | Graves | |
| 6,035,645 | A | 3/2000 | Bensaadi et al. | |
| 6,212,870 | B1 | 4/2001 | Thompson et al. | |
| 6,244,051 | B1 | 6/2001 | Zarzalis et al. | |
| 6,279,323 | B1 | 8/2001 | Monty et al. | |
| 6,314,739 | B1 | 11/2001 | Howell et al. | |
| 6,367,262 | B1 | 4/2002 | Mongia et al. | |
| 6,427,435 | B1 | 8/2002 | Patterson et al. | |
| 6,442,940 | B1 | 9/2002 | Young et al. | |
| 6,502,400 | B1 | 1/2003 | Freidauer et al. | |
| 6,550,251 | B1 | 4/2003 | Stickles et al. | |
| 7,013,649 | B2 * | 3/2006 | Monty | F23R 3/14 60/748 |
| 7,596,949 | B2 | 10/2009 | DeVane et al. | |
| 7,654,091 | B2 | 2/2010 | Al-Roub et al. | |
| 8,348,180 | B2 | 1/2013 | Mao et al. | |
| 10,132,500 | B2 | 11/2018 | Ryon et al. | |
| 10,344,981 | B2 | 7/2019 | Prociw et al. | |
| 10,731,861 | B2 | 8/2020 | Schlein | |
| 10,794,596 | B2 | 10/2020 | Dai et al. | |
| 10,830,446 | B2 | 11/2020 | Prociw et al. | |
| 11,181,272 | B2 | 11/2021 | Tentorio et al. | |
| 11,226,101 | B2 * | 1/2022 | Sampath | F23R 3/14 |
| 11,384,937 | B1 | 7/2022 | Sampath et al. | |
| 11,428,411 | B1 | 8/2022 | Pal et al. | |
| 11,592,182 | B1 * | 2/2023 | Rangrej | F23D 11/105 |
| 11,725,819 | B2 * | 8/2023 | Vukanti | F23R 3/286 60/737 |
| 11,994,295 | B2 * | 5/2024 | Naik | F23R 3/28 |
| 12,038,176 | B2 * | 7/2024 | Naik | F23R 3/50 |
| 12,072,099 | B2 * | 8/2024 | Naik | F23R 3/283 |
| 12,092,324 | B2 * | 9/2024 | Kim | F23D 14/62 |
| 12,130,013 | B2 * | 10/2024 | Vise | B05B 15/555 |
| 2003/0010034 | A1 | 1/2003 | Baudoin et al. | |
| 2003/0061815 | A1 | 4/2003 | Young et al. | |
| 2003/0131600 | A1 | 7/2003 | David et al. | |
| 2003/0196440 | A1 | 10/2003 | Steinthorsson et al. | |
| 2004/0065090 | A1 | 4/2004 | Al-Roub et al. | |
| 2004/0079086 | A1 | 4/2004 | Smith et al. | |
| 2004/0163678 | A1 | 8/2004 | Ogden et al. | |
| 2005/0039458 | A1 | 2/2005 | Leen et al. | |
| 2005/0044854 | A1 | 3/2005 | Cazalens et al. | |
| 2005/0223710 | A1 | 10/2005 | Creighton et al. | |
| 2005/0229600 | A1 | 10/2005 | Kastrup et al. | |
| 2005/0262843 | A1 | 12/2005 | Monty | |
| 2007/0269757 | A1 | 11/2007 | Commaret et al. | |
| 2007/0277528 | A1 | 12/2007 | Homitz et al. | |
| 2009/0049840 | A1 | 2/2009 | Cayre et al. | |
| 2013/0283803 | A1 | 10/2013 | Bunel et al. | |
| 2014/0165585 | A1 | 6/2014 | Burd | |
| 2016/0265779 | A1 | 9/2016 | Haynes et al. | |
| 2017/0299190 | A1 | 10/2017 | Patel et al. | |
| 2017/0363290 | A1 | 12/2017 | Mery et al. | |
| 2019/0032559 | A1 | 1/2019 | Dai et al. | |
| 2019/0086088 | A1 | 3/2019 | Stevens et al. | |
| 2019/0376689 | A1 | 12/2019 | Guezel et al. | |
| 2020/0248903 | A1 | 8/2020 | Sampath et al. | |
| 2022/0333779 | A1 * | 10/2022 | Vise | F23R 3/286 |
| 2022/0333780 | A1 | 10/2022 | Danis et al. | |
| 2023/0053389 | A1 * | 2/2023 | Vukanti | F23R 3/16 |
| 2023/0194091 | A1 | 6/2023 | Vukanti et al. | |
| 2023/0194095 | A1 | 6/2023 | Vukanti et al. | |
| 2023/0204213 | A1 | 6/2023 | Naik et al. | |
| 2023/0220993 | A1 * | 7/2023 | Bucaro | F23D 14/62 60/737 |
| 2023/0366551 | A1 | 11/2023 | Vukanti et al. | |

FOREIGN PATENT DOCUMENTS

| | | | |
|---|---|---|---|
| CN | 106016365 | A | 10/2016 |
| CN | 108224478 | A | 6/2018 |
| CN | 111520744 | A | 8/2020 |
| EP | 1391652 | B1 | 12/2006 |

* cited by examiner

TURBINE ENGINE WITH FUEL NOZZLE

CROSS-REFERENCE TO RELATED APPLICATION(S)

This application is a continuation of U.S. patent application Ser. No. 17/682,510, filed Feb. 28, 2022, currently allowed, which claims priority to and the benefit of Indian Provisional Patent Application No. 202111059696, filed Dec. 21, 2021, both of which are incorporated herein by reference in their entirety.

FIELD

The present subject matter relates generally to combustor for a turbine engine, the combustor having one or both of a fuel nozzle and a swirler.

BACKGROUND

An engine, such as a turbine engine, includes a turbine that is driven by combustion of a combustible fuel within a combustor of the engine. The engine utilizes a fuel nozzle to inject the combustible fuel into the combustor. A swirler provides for mixing the fuel with air in order to achieve efficient combustion.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
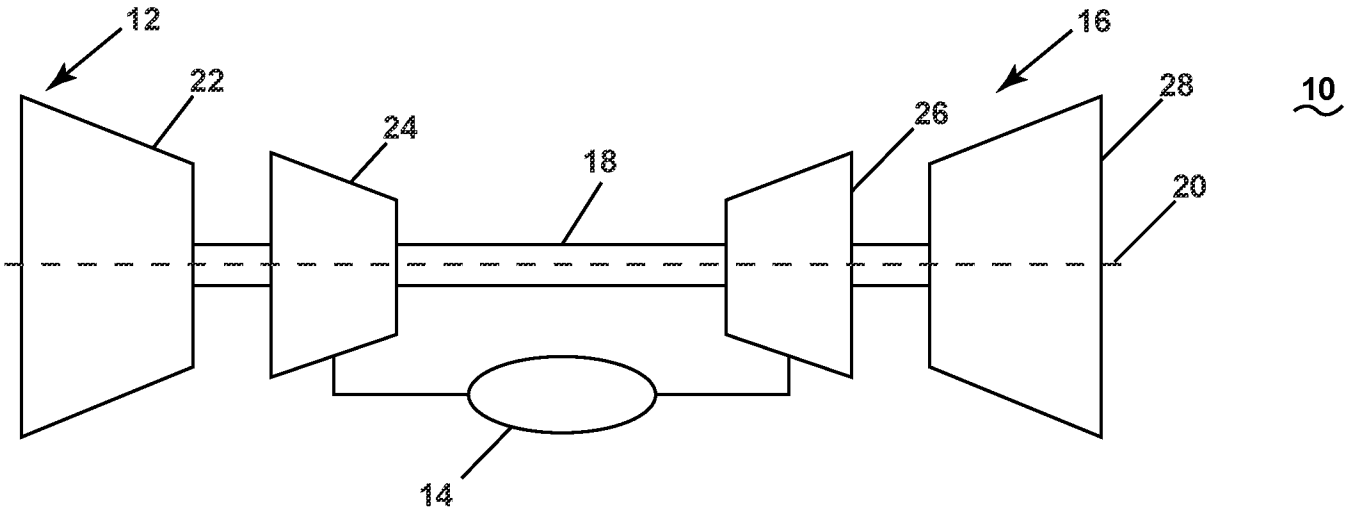
FIG. 1 is a schematic cross-sectional view of an engine in accordance with an exemplary embodiment of the present disclosure.

Aspects of the disclosure herein are directed to a fuel nozzle and swirler architecture located within an engine component, and more specifically to a fuel nozzle structure configured for use with heightened combustion engine temperatures, such as those utilizing a hydrogen fuel of hydrogen fuel mixes. Higher temperature fuels can eliminate carbon emissions, but generate challenges relating to flame holding or flashback due to the higher flame speed and high-temperatures. Current combustors may be susceptible to flame holding or flashback on combustor components when using such high-temperature fuels due. For purposes of illustration, the present disclosure will be described with respect to a turbine engine for an aircraft with a combustor driving the turbine. It will be understood, however, that aspects of the disclosure herein are not so limited, and can have application in other residential or industrial applications.

During combustion, the engine generates high local temperatures. Efficiency and carbon emission needs can be met with fuels that burn hotter than traditional fuels, or that reduce carbon emissions can be met by the use of fuels with higher burn temperatures. Such fuels can include lighter than air fuels, such as hydrogen in the gaseous phase. Utilizing current engines with fuels with higher burn temperatures and burn speeds may result in flame holding or flashback on the combustor components.

Reference will now be made in detail to the fuel nozzle and swirler architecture, and in particular for use with a turbine engine, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

The term "flame holding" relates to the condition of continuous combustion of a fuel such that a flame is maintained along or near to a component, and usually a portion of the fuel nozzle assembly as described herein, and "flashback" relate to a retrogression of the combustion flame in the upstream direction.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

The singular forms "a", "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

The combustor introduces fuel from a fuel nozzle, which is mixed with air provided by a swirler, and then combusted within the combustor to drive the engine. Increases in efficiency and reduction in emissions have driven the need to use fuel that burns cleaner or at higher temperatures. There is a need to improve durability of the combustor under these operating parameters, such as improved flame control to prevent flame holding on the fuel nozzle and swirler components.

FIG. 1 is a schematic view of an engine as an exemplary turbine engine 10. As a non-limiting example, the turbine engine 10 can be used within an aircraft. The turbine engine 10 can include, at least, a compressor section 12, a combustion section 14, and a turbine section 16. A drive shaft 18 rotationally couples the compressor and turbine sections 12, 16, such that rotation of one affects the rotation of the other, and defines a rotational axis 20 for the turbine engine 10.

The compressor section 12 can include a low-pressure (LP) compressor 22, and a high-pressure (HP) compressor 24 serially fluidly coupled to one another. The turbine section 16 can include an LP turbine 28, and an HP turbine 26 serially fluidly coupled to one another. The drive shaft 18 can operatively couple the LP compressor 22, the HP compressor 24, the LP turbine 28 and the HP turbine 26 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10.

Figure 2:
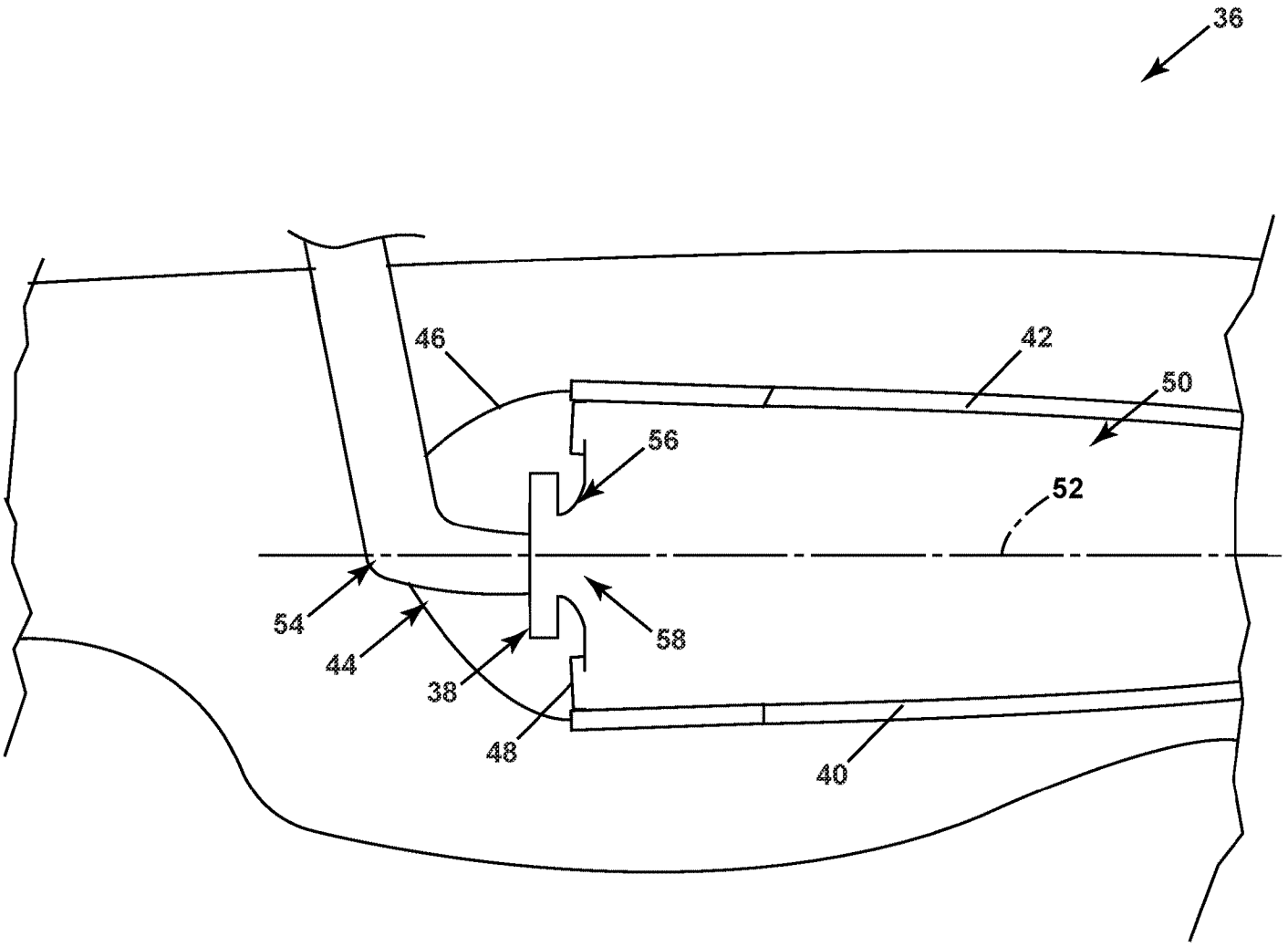
FIG. 2 is a schematic cross-sectional view of a combustor for the engine of FIG. 1 in accordance with an exemplary embodiment of the present disclosure.

FIG. 2 depicts a cross-section view of a combustor 36 suitable for use in the combustion section 14 of FIG. 1. The combustor 36 can include an annular arrangement of fuel nozzle assemblies 38 for providing fuel to the combustor. It should be appreciated that the fuel nozzle assemblies 38 can be organized as in an annular arrangement including multiple fuel injectors. The combustor 36 can have a can, can-annular, or annular arrangement depending on the type of engine in which the combustor 36 is located. The combustor 36 can include an annular inner combustor liner 40 and an annular outer combustor liner 42, a dome assembly 44 including a dome 46 and a deflector 48, which collectively define a combustion chamber 50 about a longitudinal axis 52. At least one fuel injector 54 is fluidly coupled to the combustion chamber 50 to supply fuel to the combustor 36. The fuel injector 54 can be disposed within the dome assembly 44 upstream of a flare cone 56 to define a fuel outlet 58. A swirler can be provided at the fuel nozzle assembly 38 to swirl incoming air in proximity to fuel exiting the fuel injector 54 and provide a homogeneous mixture of air and fuel entering the combustor 36.

Figure 3:
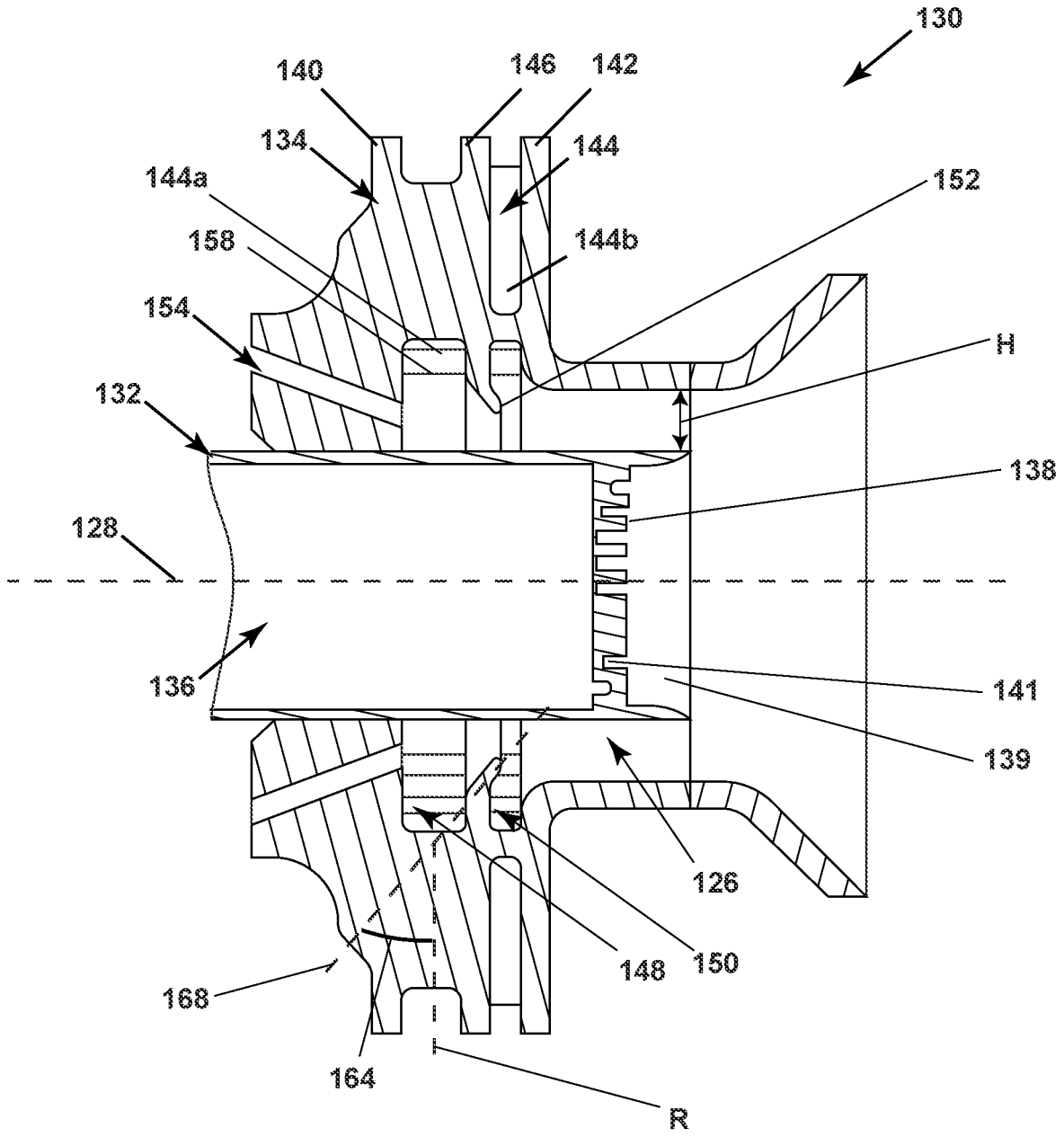
FIG. 3 is a cross-sectional view of a fuel nozzle assembly including a swirler with an aft-curved lip in accordance with an exemplary embodiment of the present disclosure.

FIG. 3 illustrates a fuel nozzle assembly 130, suitable for use in the combustor 36 as the fuel nozzle assembly 38, including a fuel nozzle 132 defining a longitudinal axis 128, and an annular swirler 134 circumscribing the fuel nozzle 132. The fuel nozzle 132 can define a fuel passage 136, with a nozzle cap 138 provided in the fuel passage 136 upstream of a nozzle tip 139, relative to the fuel direction. The nozzle cap 138 can include a set of openings 141 which may or may not impart a swirl or tangential component to the fuel emitted from the nozzle tip 139. As shown, the openings 141 are oriented tangentially, such that they appear to end within the cap 138, while it should be appreciated the openings 141 extend fully through the cap 138 such that fuel can pass through the cap 138 via the openings 141.

The swirler 134 includes a forward wall 140, an aft wall 142, and a central wall 146 with a set of vanes 144 provided therein, including a primary set of vanes 144*a* and a secondary set of vanes 144*b*, extending between the forward wall 140 and the central wall 146, and between the aft wall 142 and the central wall 146, respectively. The vanes 144 impart a tangential swirl to the airflow passing through the swirler 134 before exhausting. Furthermore, the forward wall 140 and the central wall 146 can define a forward passage 148 and the central wall 146 and the aft wall 142 can define an aft passage 150. The primary set of vanes 144*a* can have a lesser swirl number compared to the secondary set of vanes 144*b*. Lower swirl from the primary set of vanes 144*a* achieves an increased axial velocity component along the fuel nozzle outer diameter to prevent flame holding. A higher swirl from the secondary set of vanes 144*b* achieves higher flow velocity on a diverging flare cone that prevents flame holding. In one non-limiting examples, the swirl from primary set of vanes 144*a* can be from 0.0 to 0.6 where swirl from the second set of vanes 144*b* can be from 0.0 to 1.5, while wider ranges are contemplated.

A lip 152 extends in the downstream direction from the vanes 144 at the central wall 146 between the forward and aft passages 148, 150. The lip 152 extends in the radially inward direction, relative to the longitudinal extent of the fuel nozzle 132, and then curves, turning in the aft direction. The lip 152 provides a high velocity component along the fuel nozzle 132, which can reduce or eliminate flame holding and flashback along the fuel nozzle assembly. Furthermore, fuels with high burn speeds or temperatures, such as hydrogen, compared to common fuel can be utilized, while current systems would have durability issues under those operating conditions. Utilizing a hydrogen fuel can provide for reducing or eliminating emissions, such as carbon emissions, while maintaining or improving engine efficiency.

A purge opening 154, which can be arranged as a set of circumferentially-arranged openings in one non-limiting example, can extend through the swirler 134 and the forward wall 140 and fluidly couple to the swirler 134 through the forward wall 140. The purge opening 154 can be angled toward the fuel nozzle 132, while it is further contemplated that the purge openings 154 can include a tangential component, such that the purge airflow provided by the purge openings 154 can be similar to a swirling airflow provided from the vanes 144 of the swirler 134, which can reduce shear between the two airflows.

The aft curved lip 152 can be positioned between the forward passage 148 and the aft passage 150, to provide for directing the airflow along the fuel nozzle 132 with a high velocity component. The curvature of the lip 152 provides for decreased wakes or smaller wake distances by utilizing the flow from the forward passage 148 to reduce or eliminate wake formed by the lip 152.

A passage height H can be defined as the distance between the fuel nozzle 132 and the aft wall 142 of the swirler 134 downstream of the lip 152, where the cross-sectional area for the passage height H can be constant extending in the aft direction along the aft wall 142. Where the cross-sectional area defined by the passage height is non-constant, the passage height H can be defined as the smallest distance between the fuel nozzle 132 and the aft wall 142, downstream of the lip 152. In one example, the lip 152 can extend radially inward, toward and relative to the axial extent of the fuel nozzle 132.

Furthermore, the curvature of the lip 152 can be defined. Specifically, the lip 152 can begin extending at a 0-degree angle, relative to a radial direction R defined by the axial extent of the fuel nozzle 132. The lip 152 can turn, curving from the axial extent toward the aft direction. Additionally, the lip 152 can be arranged at an incline relative to the fuel nozzle 132, defining a lip axis 168, which can define an angle 164 between 1-degree and 85-degrees relative to a radial axis R, while such a curvature would be 5-degrees offset from an axis parallel to the longitudinal axis 128. Additionally, other ranges are contemplated, such as any angle between 90-degrees and 0-degrees (zero degrees). In other examples, it is contemplated that the curvature can vary, such as varying in the circumferential direction, or in the radial direction along a circumferential axis, which can be aligned with or offset with the purge openings 154 in one non-limiting example. Such a variation can be +/−5-degrees, for example, while other or greater ranges are contemplated.

Figure 4:
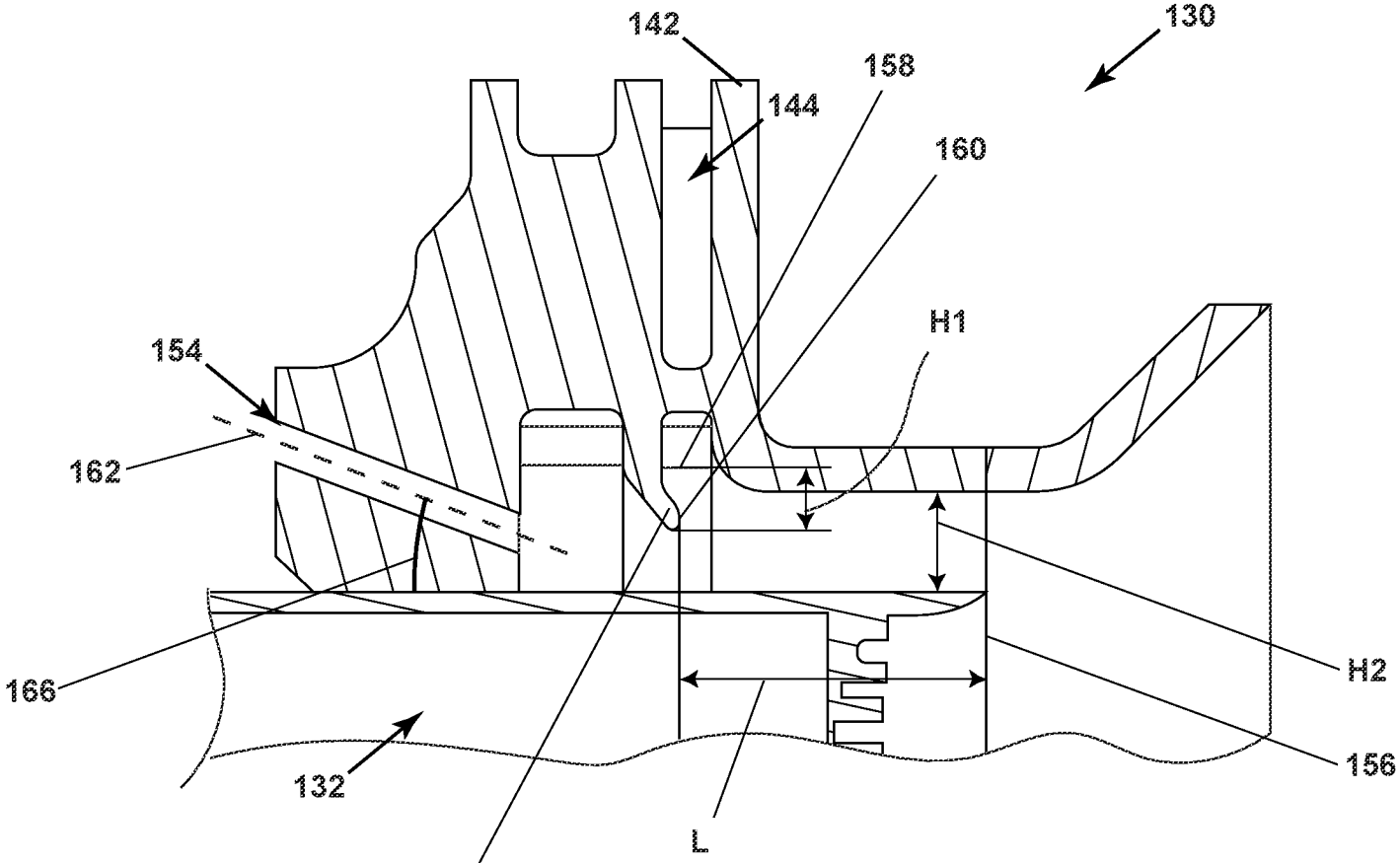
FIG. 4 is a cross-sectional view of the fuel nozzle assembly of FIG. 3, depicting various geometries for arranging the lip in accordance with an exemplary embodiment of the present disclosure.

FIG. 4 illustrates a lip height that can be defined as a first height H1 and a swirler passage height can be defined as a second height H2. The first height H1 can be defined as the radial distance between a trailing edge 158 of the vanes 144 and an aft end 160 of the lip 152, defined along a ray extending from the longitudinal axis 128 of FIG. 3. The second height H2 can be defined as the radial distance between the fuel nozzle 132 and the aft wall 142. In one example, the first height H1 can be defined between −0.9H2 to 0.9H2. That is, the first height H1 can be between 0.9 times the second height H2 with the lip 152 positioned radially exterior of the trailing edge 158 of the vanes 144, or can be 0.9 times the second height H2 with the lip 152 positioned radially interior of the trailing edge 158 of the vanes 144. In another example, the lip can extend radially inward from between 0.2H2 and 0.8H2, while additional or wider ranges are contemplated.

In yet another example, a swirler passage length L can be defined as the axial distance between the aft end 160 of the lip 152 and a nozzle tip 156 of the fuel nozzle 132. The length L can be defined parallel to the fuel nozzle 132, for example. The lip 152 can be sized or arranged such that the swirler passage length L can be between one (1) to six (6) times H2, while other ranges or sizes are contemplated.

In yet another example, the purge opening 154 can define a purge opening axis 162 as a centerline through the purge opening 154. The purge opening 154 can be arranged such that the purge axis 162 is defined at an angle 166 relative to the fuel nozzle 132, or the longitudinal axis 128 defined by the fuel nozzle 132 in FIG. 3. The angle 166 can be between negative-ten (−10) degrees and sixty (60) degrees, where a negative angle represents the purge opening 154 oriented away from the fuel nozzle 132, and a positive angle represents the purge opening 154 oriented toward the fuel nozzle 132. Orienting the purge opening 154 toward the fuel nozzle 132 can impinge a purge flow along the fuel nozzle 132, which can provide a higher velocity component along the outer diameter of the fuel nozzle 132, which can reduce flashback or flame holding at the fuel nozzle 132. The axial position of the fuel nozzle 132 can be such that the purge opening 154 impinges upon the fuel nozzle 132, or such that the purge opening 154 impinges upon the fuel nozzle tip 156.

Figure 5:
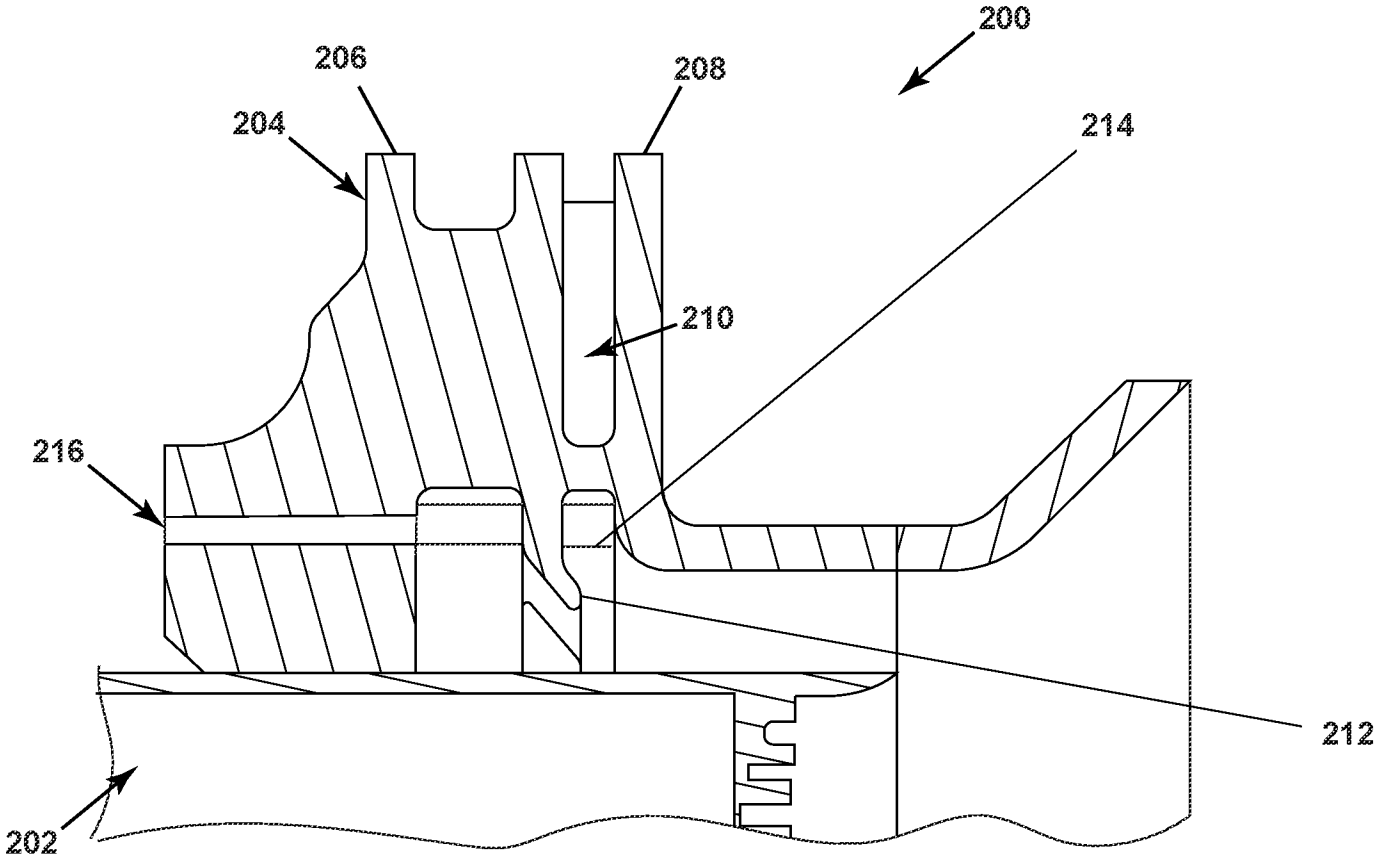
FIG. 5 is a cross-sectional view of an alternative fuel nozzle including a purge flow behind a swirler lip in accordance with an exemplary embodiment of the present disclosure.

Turning to FIG. 5, an alternative fuel nozzle assembly 200 includes a fuel nozzle 202 and a swirler 204. The swirler 204 includes a forward wall 206 and an aft wall 208, with a set of vanes 210 extending between the forward wall 206 and the aft wall 208. A swirler lip 212 extends from the trailing edge 214 of the set of vanes 210. A purge opening 216 can extend axially, and can be arranged parallel to the fuel nozzle 202, for example. The purge opening 216 can be arranged forward of the swirler lip 212, such that there is no line-of-sight of the purge opening 216 when viewed axially into the fuel nozzle assembly 200 opposite of the flow direction. Said another way, the purge opening 216 or an outlet thereof, can be axially aligned and axially overlap with the swirler lip 212. Eliminating the direct line-of-sight for the purge opening 216 can reduce or eliminate flashback at the fuel nozzle assembly 200, or risk thereof to the purge openings 216.

Figure 6:
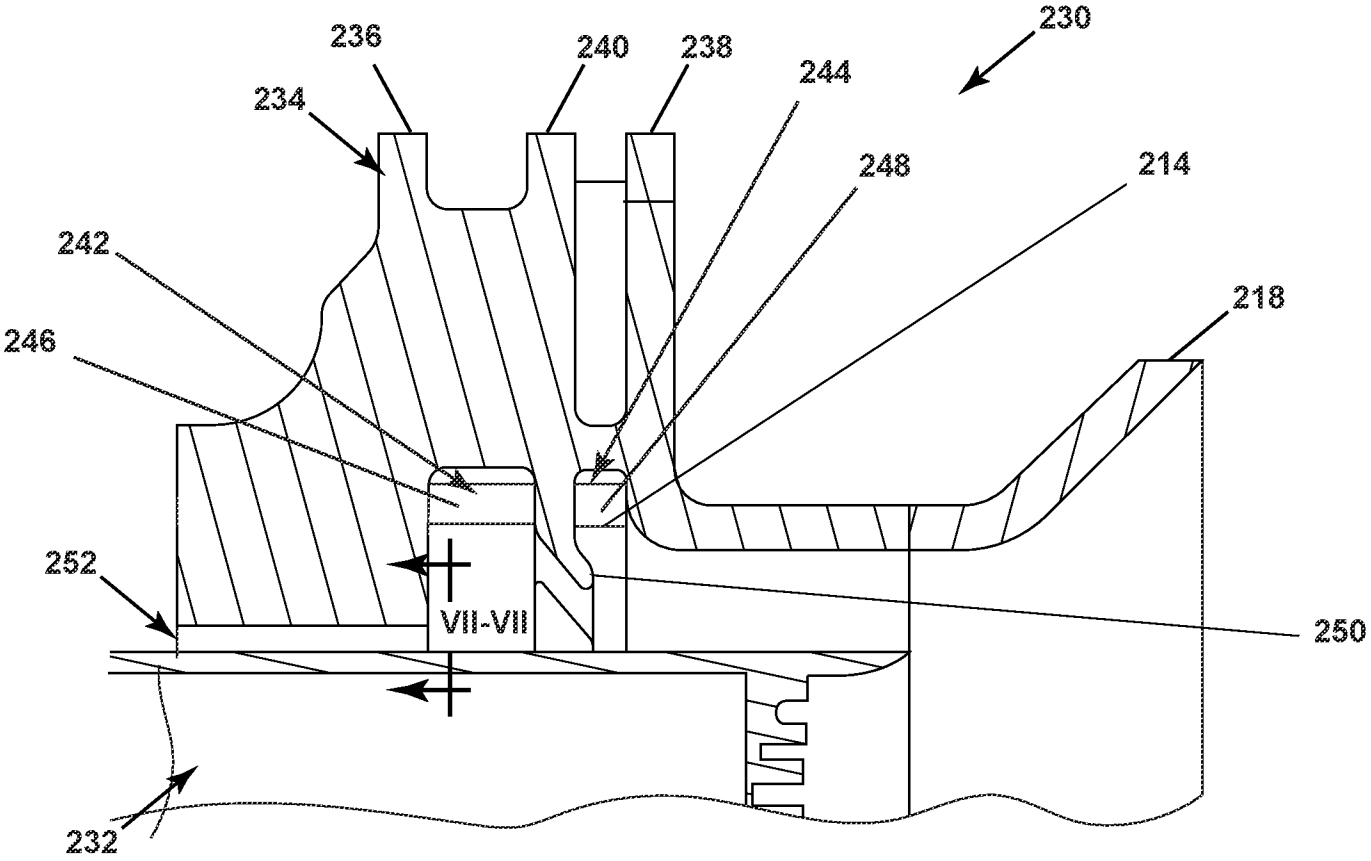
FIG. 6 is a cross-sectional view of an alternative fuel nozzle including a set of axial slots aligned along the outer diameter of a fuel nozzle, forward of a swirler lip in accordance with an exemplary embodiment of the present disclosure.

FIG. 6 shows another alternative fuel nozzle assembly 230 including a fuel nozzle 232 and a swirler 234. The swirler 234 includes a forward wall 236 and an aft wall 238, with a center wall 240 therebetween defining a primary swirler passage 242 and a secondary swirler passage 244. A set of primary vanes 246 is provided in the primary swirler passage 242, and a set of secondary vanes 248 is provided in the secondary swirler passage 244. An annular lip 250 extends from the center wall 240 at the sets of vanes 246, 248, curving or angled from a radial direction to an axial direction.

Figure 7:
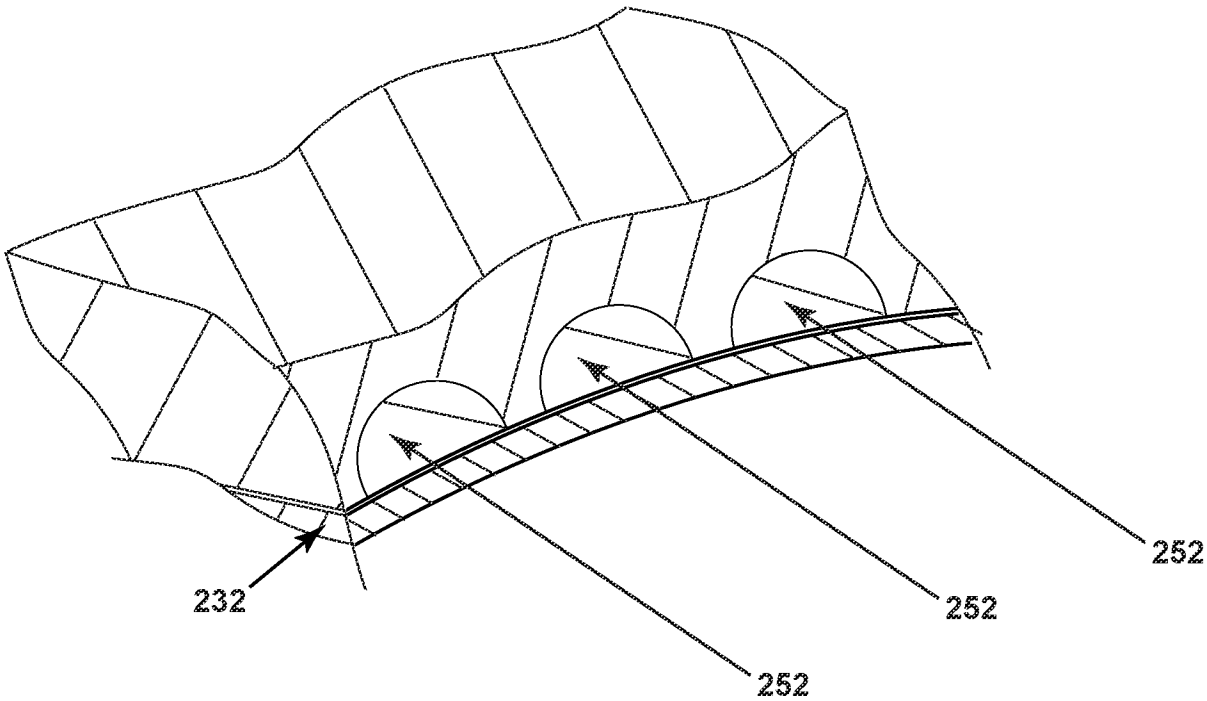
FIG. 7 is a perspective view of the axial slots taken along section VII-VII of FIG. 6, showing the cross-sectional shape and arrangement for the axial slots in the circumferential direction in accordance with an exemplary embodiment of the present disclosure.

A set of purge openings 252 are shaped into the swirler 234 and partially defined by the outer diameter of the fuel nozzle 232. Referring briefly to FIG. 7, it should be appreciated that the purge openings 252 can be formed as sets of discrete openings, which can include grooves or slots formed into the inner diameter wall of the swirler 234, extending parallel to the fuel nozzle 232. The cross-sectional shape for the purge openings 252, best seen in FIG. 7 taken across section VII-VII of FIG. 6, can be semicircular, while alternative shapes are contemplated, such as circular, elliptical, semielliptical, triangular, squared, rounded, or combinations thereof in non-limiting examples. Additionally, an annular opening extending fully around the fuel nozzle 232 is contemplated. The annular shape of the fuel nozzle 232 can be appreciated as shown.

Returning to FIG. 6, in operation, a flow of air is provided through the swirler 234 to impart a swirl or tangential component to the flow of air in the primary and secondary swirler passages 242, 244. The purge openings 252 provide a high velocity along the outer diameter of the fuel nozzle 232, which can reduce or eliminate flame holding or flashback on the fuel nozzle 232. A higher tangential component in the secondary swirler passage 244 can reduce or eliminate flame holding on the flare cone 218. The purge openings 252 can be arranged tangentially, complementary or equivalent to the tangential swirl imparted by the primary swirler passage 242.

Figure 8:
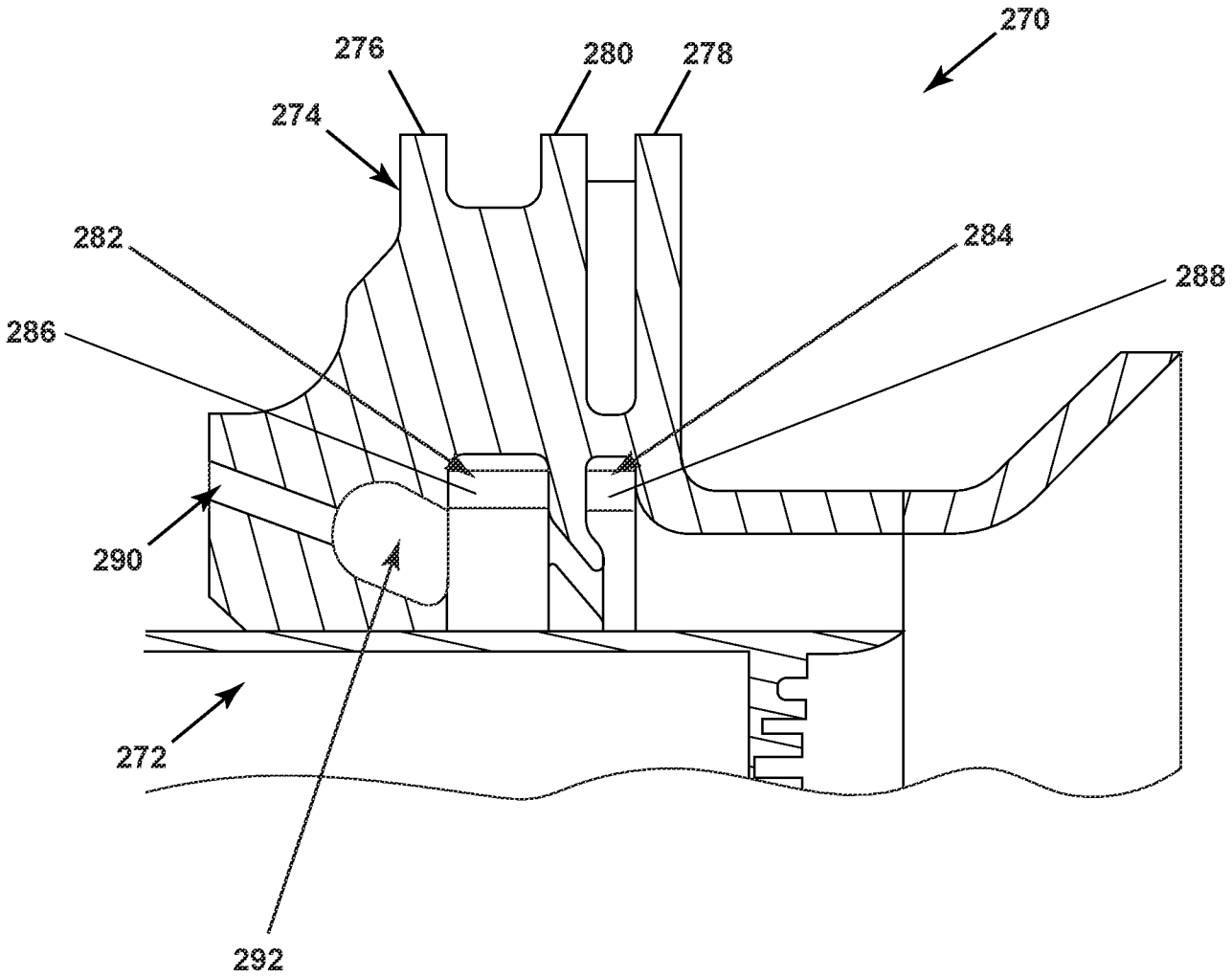
FIG. 8 is a cross-sectional view of another alternative fuel nozzle assembly including discrete purge holes exhausting to an annular groove prior to exhausting to a swirler in accordance with an exemplary embodiment of the present disclosure.

Referring to FIG. 8, another alternative fuel nozzle assembly 270 includes a fuel nozzle 272 and a swirler 274. The swirler 274 includes a forward wall 276, an aft wall 278, and a center wall 280 therebetween defining a primary swirler passage 282 and a secondary swirler passage 284. A first set of vanes 286 is provided in the primary swirler passage 282 and a second set of vanes 288 is provided in the secondary swirler passage 284.

A set of purge openings 290 are circumferentially arranged about the swirler 274 forward of the forward wall 276. The purge openings 290 can couple to an annular groove s formed into the forward wall 276, which can be common to all purge openings 290 in the set of purge openings 290. The groove 292 can include a rounded profile, while any profile is contemplated, such as rounded, curved, linear, curvilinear, geometric, circular, elliptical, squared, or combinations thereof in non-limiting examples. Furthermore, the groove 292 can be shaped to define a converging cross-sectional area in the flow direction to provide an increased velocity component for the flow emitted from the groove 292, which can reduce flame holding or flashback at the fuel nozzle 272. Alternatively, it is contemplated that the groove 292 can include a constant cross-section or a diverging cross-section. Furthermore, the purge openings 290 can be inclined, or angled toward the fuel nozzle 272, while other suitable arrangements are contemplated, such as a radially-angular component, an axially-angular component, a circumferentially-angular component, or combination thereof. Further still, the cross-sectional area can vary in the circumferential direction, which may or may not relate to the arrangement of the purge openings 290. The groove 292 can further provide for even spread of a purge flow before supply to the swirler 274, which can reduce shear turbulence generated from discrete purge opening outlets.

Figure 9:
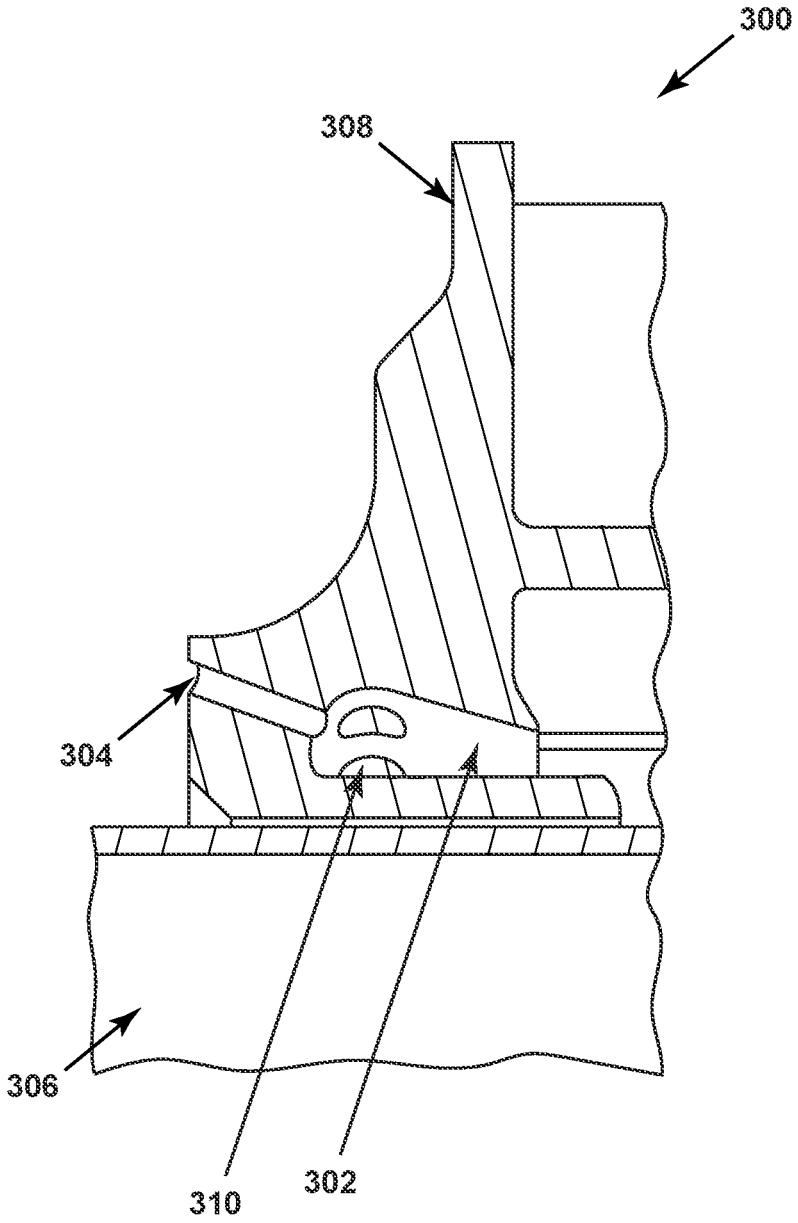
FIG. 9 is cross-section view of yet another alternative fuel nozzle assembly including rows of purge holes exhausting to an annular groove prior to exhausting to a swirler in accordance with an exemplary embodiment of the present disclosure.

FIG. 9 shows another alternative fuel nozzle assembly 300, which can be similar to that of FIG. 8, except that an annular groove 302 can be fed from multiple purge openings 304, which can be in a stacked arrangement 310, stacked in a radial direction relative to a fuel nozzle 306 of the fuel nozzle assembly 300. It should be appreciated that utilizing different arrangements of purge openings 304 can provide a uniform supply of air to the annular groove 302, which can be utilized to provide circumferentially-uniform flow profiles to a swirler 308, while utilizing discrete purge openings 304. Discrete or complex geometries can provide for tailoring an air profile emitted from the purge openings to the swirler 308. Such geometries can be utilized to improve velocity along the fuel nozzle 306 to reduce flame holding on the nozzle tip, or improved swirl which can reduce flame holding on a flare cone or combustor liner.

Figure 10:
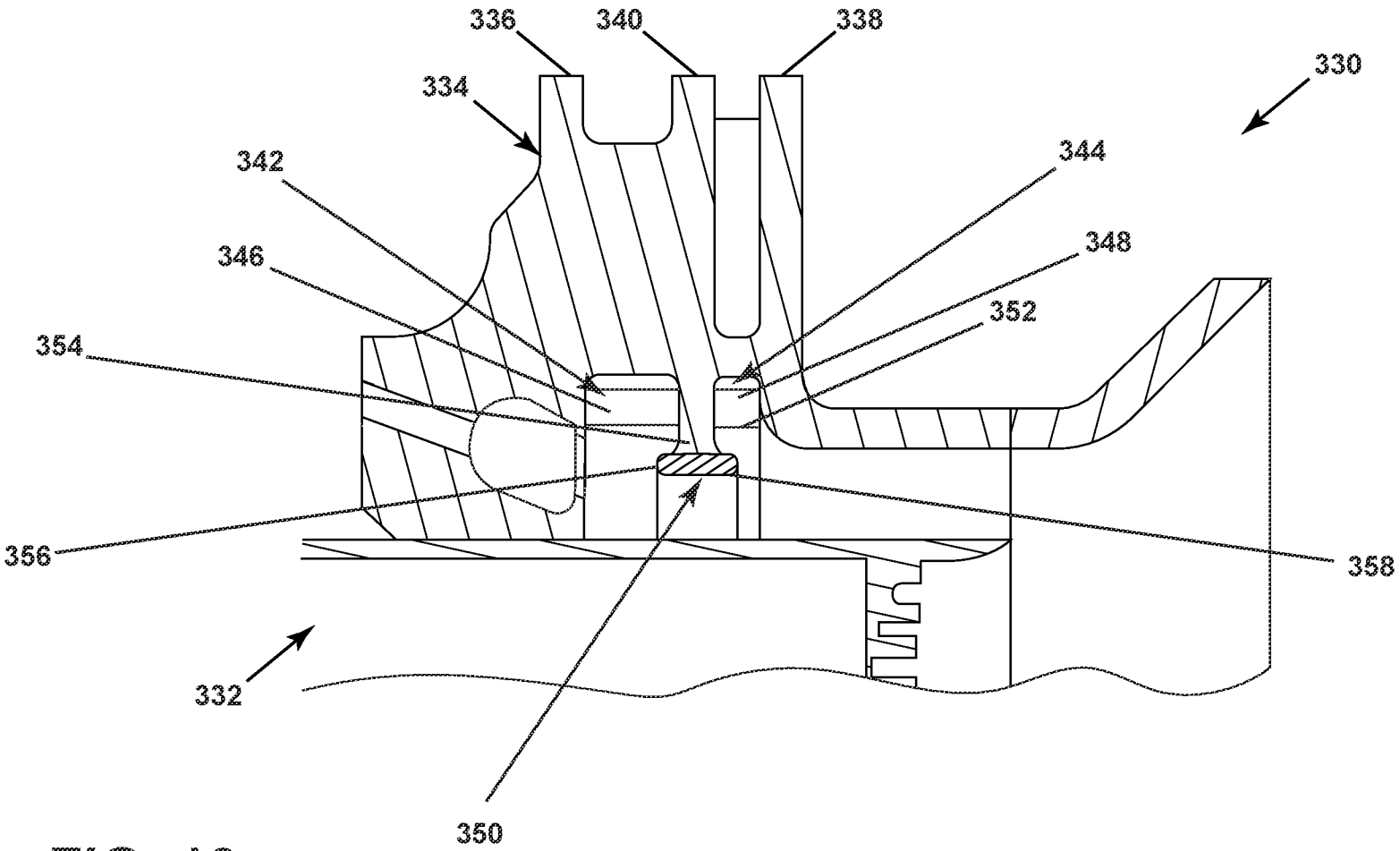
FIG. 10 is a cross-sectional view of yet another alternative fuel nozzle assembly including a t-shaped lip in accordance with an exemplary embodiment of the present disclosure.

FIG. 10 depicts yet another alternative fuel nozzle assembly 330 including a fuel nozzle 332 and a swirler 334. The swirler 334 includes a forward wall 336 and an aft wall 338, with a central wall 340 therebetween defining a first passage 342 and a second passage 344. A first set of vanes 346 is provided in the first passage 342 and a second set of vanes 348 is provided in the second passage 344. A lip 350 extends radially inward from the central wall 340 at a trailing edge 352 of the vanes 346, 348. The lip 350 includes a t-shaped profile, such that a first portion 354 of the lip 350 extends in the radial direction, which splits into a forward portion 356 and an aft portion 358 extending forward and aft from the first portion 354, respectively.

The t-shape of the lip 350 defines a constant cross-sectional area defined in the radial direction from the forward and aft portions 356, 358 to the fuel nozzle 332. The constant cross-sectional area provides a higher axial velocity component along the outer diameter of the fuel nozzle 332, which can provide for reducing or eliminating flame holding or flashback at the fuel nozzle 332.

It should be appreciated that fuels with higher burn temperature and higher burn speeds, or lighter weights relative to air or other fuels, can provide for reducing or eliminating emissions, or improving efficiency without increasing emissions. In one example, hydrogen fuels or hydrogen-based fuels can be utilized, which can eliminate carbon emissions without negative impact to efficiency. Such fuels, including hydrogen, require greater flame control, in order to prevent flame holding or flashback on the combustor hardware. The aspects described herein can increase combustor durability, while current combustors fail to provide durability to utilize such fuels.

It should be appreciated that the examples used herein are not limited specifically as shown, and a person having skill in the art should appreciate that aspects from one or more of the examples can be intermixed with one or more aspect from other examples to define examples that can differ from the examples as shown.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses: a turbine engine comprising: a compressor section, combustor section, and turbine section in serial flow arrangement, with the combustor section including a fuel nozzle assembly comprising: a fuel nozzle terminating at a nozzle tip, the fuel nozzle defining a longitudinal axis, and including a fuel passage; a swirler, defining a swirler passage, with an outlet provided the fuel nozzle; a set of vanes provided within the swirler; and a lip extending downstream from the set of vanes relative to the flow of air through the swirler.

The turbine engine of any preceding clause, wherein the swirler further comprises a forward wall and an aft wall, with the set of vanes extending between the forward wall and the aft wall.

The turbine engine of any preceding clause, further comprising a center wall provided between the forward wall and the aft wall, and wherein the set of vanes includes a first set of vanes extending between the forward wall and the center wall, and a second set of vanes extending between the center wall and the aft wall.

The turbine engine of any preceding clause, wherein the lip extends from the center wall.

The turbine engine of any preceding clause, wherein the first set of vanes are arranged to impart a swirl between 0.0 and 0.6, and the second set of vanes are arranged to impart a swirl between 0.0 and 1.5

The turbine engine of any preceding clause, wherein the lip defines a lip height as a radial distance perpendicular to the longitudinal axis, defined from a trailing edge of the set of vanes to and end of the lip.

The turbine engine of any preceding clause, wherein the swirler passage defines swirler height as a radial length between the fuel nozzle and the swirler in the direction perpendicular to the longitudinal axis.

The turbine engine of any preceding clause, wherein the lip height can be between −0.9 times the swirler height to 0.9 times the swirler height.

The turbine engine of any preceding clause, wherein a swirler passage length defined axial distance between the lip and the nozzle tip, and wherein the lip height can be between one to six times the swirler passage length.

The turbine engine of any preceding clause, wherein the lip curves in an aft direction.

The turbine engine of any preceding clause, wherein the lip is inclined at an angle relative to the longitudinal axis, and wherein the angle is between 1-degree and 85-degrees.

The turbine engine of any preceding clause, wherein the lip has a t-shaped profile.

The turbine engine of any preceding clause, further comprising a purge opening extending through the swirler.

The turbine engine of any preceding clause, wherein the purge opening is arranged at an angle relative to the longitudinal axis, wherein the angle is between negative ten degrees and 60 degrees.

The turbine engine of any preceding clause, wherein the purge opening is axially aligned with the lip.

The turbine engine of any preceding clause, wherein the purge opening further comprises a groove.

The turbine engine of any preceding clause, wherein the purge opening is arranged as multiple stacked purge openings.

A fuel nozzle assembly comprising: a fuel nozzle, defining longitudinal axis, including a fuel passage terminating at a nozzle tip; a swirler, defining a swirler passage, provided about the fuel nozzle; a set of vanes provided within the swirler configured to impart a swirl to a flow of air through the swirler; a lip extending downstream from the set of vanes relative to the flow of air through the swirler.

A method of injecting fuel from a fuel nozzle assembly, the method comprising: injecting a volume of fuel from a fuel nozzle; and providing a volume of air from a swirler along a lip; wherein the lip provides for an increased axial velocity component along the fuel nozzle as compared to a fuel nozzle assembly without the lip.

The method of any preceding clause, wherein the lip is curved in the aft direction.

What is claimed is:

1. A turbine engine comprising:

a compressor section, combustor section, and turbine section in serial flow arrangement, with the combustor section including a fuel nozzle assembly comprising:

a fuel nozzle including a fuel passage defining a longitudinal axis, the fuel nozzle terminating at a nozzle tip;

a swirler defining a swirler passage about the fuel nozzle, having a forward wall spaced from an aft wall, and having a center wall positioned between the forward wall and the aft wall;

a set of vanes provided within the swirler;

a lip extending downstream from the center wall relative to a flow direction through the swirler, and the lip terminating at an aft end; and a purge opening extending through the forward wall and exhausting to the swirler passage;

wherein the nozzle tip is positioned aft of the aft end of the lip relative to the longitudinal axis.

2. The turbine engine of claim 1, wherein the aft end of the lip is positioned forward of the aft wall relative to the longitudinal axis.

3. The turbine engine of claim 1, wherein the purge opening is one of a set of purge openings in annular arrangement about the fuel nozzle.

4. The turbine engine of claim 1, wherein the purge opening is provided as an annular opening in annular arrangement about the fuel nozzle.

5. The turbine engine of claim 1, wherein the purge opening defines a purge axis and wherein the purge opening is arranged such that the purge axis defines an angle relative to the longitudinal axis.

6. The turbine engine of claim 5, wherein the angle is between negative ten degrees and sixty degrees.

7. The turbine engine of claim 5, wherein the purge opening is oriented to impinge upon the fuel nozzle.

8. The turbine engine of claim 1, wherein the purge opening is arranged parallel to the longitudinal axis.

9. The turbine engine of claim 1, wherein the purge opening axially overlaps with the lip in a direction parallel to the longitudinal axis.

10. The turbine engine of claim 1, wherein the purge opening extends through the forward wall along the fuel nozzle.

11. The turbine engine of claim 1, wherein the purge opening includes a semicircular cross-sectional shape.

12. The turbine engine of claim 1, further comprising an annular groove arranged within the forward wall between the purge opening and the swirler passage.

13. The turbine engine of claim 12, wherein the purge opening is provided as multiple purge openings in stacked arrangement exhausting to the annular groove.

14. The turbine engine of claim 1, wherein the swirler passage defines a swirler height as a radial length between the fuel nozzle and the swirler in a direction perpendicular to the longitudinal axis, and wherein the lip height can be between −0.9 times the swirler height to 0.9 times the swirler height.

15. The turbine engine of claim 14, wherein a swirler passage length is defined as an axial distance between the lip and the nozzle tip, and wherein the lip height can be between one to six times the swirler passage length.

16. A fuel nozzle assembly comprising:

a fuel nozzle including a fuel passage defining a longitudinal axis, the fuel nozzle terminating at a nozzle tip;

a swirler defining a swirler passage about the fuel nozzle, having a forward wall spaced from an aft wall, and having a center wall positioned between the forward wall and the aft wall;

a lip extending downstream from the center wall relative to a flow direction through the swirler, and the lip terminating at an aft end; and a purge opening extending through the forward wall and exhausting to the swirler passage;

wherein the nozzle tip is positioned aft of the aft end of the lip relative to the longitudinal axis.

17. The fuel nozzle assembly of claim 16, wherein the aft end of the lip is positioned forward of the aft wall relative to the longitudinal axis.

18. The fuel nozzle assembly of claim 16, wherein the purge opening defines a purge axis and wherein the purge opening is arranged such that the purge axis defines an angle relative to the longitudinal axis.

19. The fuel nozzle assembly of claim 18, wherein the purge axis orients the purge opening to impinge upon the fuel nozzle.

20. The fuel nozzle assembly of claim 1, further comprising an annular groove arranged within the forward wall between the purge opening and the swirler passage.

* * * * *